United States Patent [19]

Robertson et al.

[11] 4,228,751

[45] Oct. 21, 1980

[54] UNDERWATER VIEWING APPARATUS

[76] Inventors: Larry M. Robertson; Calvin A. Robertson, both of 2860 Lenox, Troy, Mich. 48098

[21] Appl. No.: 935,658

[22] Filed: Aug. 21, 1978

[51] Int. Cl.[3] ..... A63C 5/00

[52] U.S. Cl. ..... 114/66; 9/310 H

[58] Field of Search ..... 9/310 H, 310 R; 114/66

[56] References Cited

U.S. PATENT DOCUMENTS

| | | | |
|---|---|---|---|
| 1,149,678 | 8/1915 | Parker | 114/66 |
| 1,675,965 | 7/1928 | Weinreich | 114/66 |
| 1,763,464 | 6/1930 | Gunderson et al. | 114/66 |
| 2,712,139 | 7/1955 | Kelly | 114/66 |
| 3,081,726 | 3/1963 | Betts et al. | 114/66 |

FOREIGN PATENT DOCUMENTS

| | | | |
|---|---|---|---|
| 968375 | 11/1950 | France | 114/66 |
| 2271109 | 5/1974 | France | 114/66 |

*Primary Examiner*—Trygve M. Blix
*Assistant Examiner*—Jesus D. Sotelo
*Attorney, Agent, or Firm*—Gifford, VanOphem, Sheridan & Sprinkle

[57] ABSTRACT

An underwater viewing apparatus is provided in combination with a boat having a hull. The apparatus includes a hollow housing open at each end. The lower end of the housing is secured to the bottom of the hull in registry with an opening cut through the hull so that the housing extends vertically upwardly and so that the upper end of the housing is positioned above the water line for the boat. A transparent sheet is positioned over the hull opening and fluidly sealed to both the hull and the housing so that in the event of breakage of the transparent sheet, water will flow through the hull opening only into the interior of the housing and only up to the water level of the boat.

4 Claims, 3 Drawing Figures

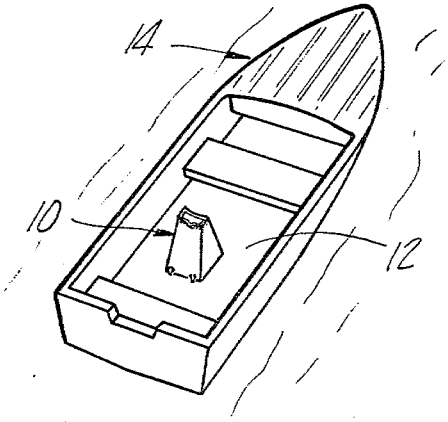
Fig-1
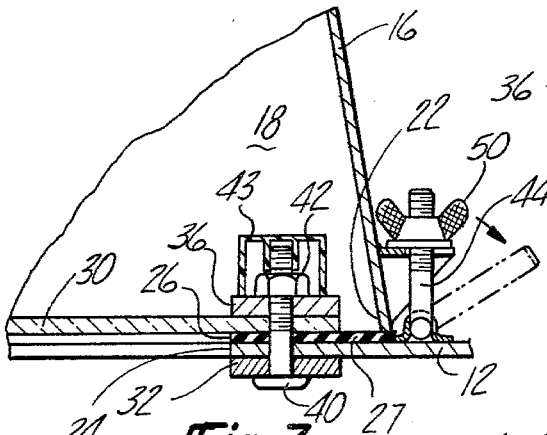
Fig-3
Fig-2
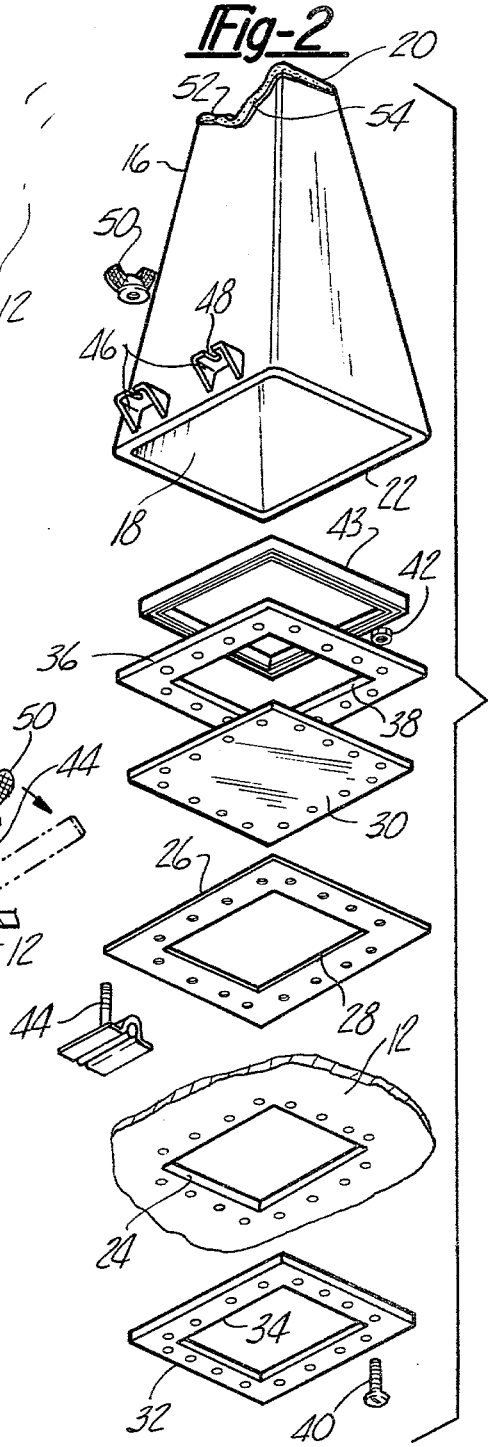

UNDERWATER VIEWING APPARATUS

BACKGROUND OF THE INVENTION

I. Field of the Invention

The present invention relates to an underwater viewing device for use with a boat.

II. Description of the Prior Art

There have been a number of previously known underwater viewing devices for use with boats, submarines, and other aquatic vehicles. While many of these devices are adapted to be positioned over the side of the boat with one end inserted in the water, still others are adapted for use in conjunction with an opening formed through the bottom of the boat hull. Such a device, for example, is described in U.S. Pat. No. 1,149,678 which issued on Aug. 10, 1915 to J. T. Parker.

These previously known underwater viewing devices of the latter type, however, suffer from a number of common disadvantages. One prime disadvantage of these previously known underwater viewing devices is that many devices are unnecessarily bulky, and therefore both expensive and space consuming. Since it is impractical to devote a major portion of the interior or most boats to an underwater viewing device, these previously known underwater viewing devices have not enjoyed widespread use or acceptance.

A still further disadvantage of the previously known underwater viewing devices is that conventionally only a sheet of glass or other fragile, transparent material is positioned across the hull opening to prevent the entry of water into the interior of the boat. These transparent sheets, however, are prone to breakage, particularly when operating the boat in rocky and/or shallow water. Breakage of the transparent sheet disadvantageously permits water to enter into the interior of the boat and will sink the boat unless the shore can be rapidly reached.

A still further disadvantage of many of these previously known underwater viewing devices is that entry of light into the interior of the viewing device interferes with the desired underwater view. Several prior known viewing devices, such as described in U.S. Pat. No. 1,371,986 which issued on Mar. 15, 1921 to F. I. Stiles, employed complex shutter or blind arrangements in order to block external light. These previously known attempts to block external light, however, are not only unduly expensive and complex in construction, but have also proved to be inadequate in operation.

A still further disadvantage of these prior devices is that a person cannot simultaneously operate the viewing device and the boat.

SUMMARY OF THE PRESENT INVENTION

The present invention overcomes the above mentioned disadvantages of the previously known underwater viewing devices by providing such a device which is not only simple, inexpensive, and compact in construction but also totally effective and safe in use.

In brief the underwater viewing apparatus according to the present invention comprises a hollow housing constructed of an opaque material and having an open upper and lower end. The lower open end of the housing is positioned in registry with an opening formed through the bottom of the hull so that the top of the housing extends vertically upwardly from the hull opening and is positioned above the water line or level for the boat.

A transparent sheet constructed from glass, plexiglass or similar material is positioned across the hull opening while a resilient gasket is sandwiched between the transparent sheet and the bottom of the hull. Plexiglass is a trademark of Rohm & Haas Co. The resilient gasket includes a central opening in registry with the hull opening and serves several distinct functions.

First, the gasket seals the lower end of the housing to the boat hull and thus not only prevents fluid leakage through the hull opening and into the boat but also prevents the entry of light into the interior of the housing between the bottom of the housing and the boat hull. Moreover, upon accidental breakage of the transparent sheet, the resilient gasket insures that all water flow through the hull opening is retained within the interior of the housing. Since the upper end of the housing is positioned above the boat water line, breakage of the transparent sheet will not cause flooding of the boat.

The upper end of the housing is furthermore contoured to abut against the face and around the eyes of the user. In doing so, all light seepage into the interior of the housing is eliminated except for the light which desirably enters the housing through the transparent sheet.

BRIEF DESCRIPTION OF THE DRAWINGS

A better understanding of the present invention will be had upon reference to the following detailed description when read in conjunction with the accompanying drawing wherein like reference characters refer to like parts throughout the several views, and in which:

FIG. 1 is a perspective view illustrating the underviewing apparatus according to the present invention installed in a boat;

FIG. 2 is an exploded view illustrating the underwater viewing apparatus according to the present invention; and FIG. 3 is a fragmentary sectional view illustrating the means for attaching the viewing apparatus according to the present invention to the bottom of the boat hull.

DETAILED DESCRIPTION OF THE PRESENT INVENTION

With reference first to FIG. 1, the underwater viewing apparatus 10 according to the present invention is thereshown secured to the hull 12 of a boat 14 in a fashion which will subsequently be described in greater detail. While the boat 14 can be of any type, as shown, it is a 2–4 man craft of the type commonly used for fishing. For such boats, the hull 12 is typically constructed of aluminum, fiberglass or similar material.

Referring now to FIGS. 2 and 3, the viewing apparatus 10 according to the present invention is thereshown in greater detail and comprises a housing 16 having a hollow interior 18 open at both its upper end 20 and its lower end 22. The housing 16 is constructed from an opaque material such as aluminum or a thermo plastic and tapers outwardly from its upper end 20 to its lower end 22. The housing 16 is preferably rectangular in cross-sectional shape.

In order to install the viewing apparatus 10 within the boat 14, a rectangular opening 24 is first cut through the boat hull 12. A rectangular resilient gasket 26 having a rectangular central opening 28 is then positioned on the interior of the boat hull 12 and so that the openings 28 and 24 register with each other. A rectangular transparent sheet 30, constructed of Plexiglass, tempered safety glass, or the like, is in turn positioned on top of the gasket 26 so that the sheet 30 covers the opening 28. The rubber gasket 26, however, is larger in size than the sheet 30 so that a portion 27 (FIG. 3) of the gasket 26 extends outwardly from each side of the transparent sheet 30.

In order to compress the transparent sheet 30 against the gasket 26 and thereby provide a fluid seal between the sheet 30 and the hull 12 of the boat 14, a lower rectangular frame member 32 having an opening 34, is positioned on the bottom exterior of the boat hull 12 while a similar rectangular frame member 36 having a central opening 38 is positioned on top of the transparent sheet 30 within the interior of the boat 14. The frame members 32 and 36 are secured together by suitable means, such as bolts 40 and nuts 42 extending through registry apertures in the frame members 32 and 36, the boat hull 12, the gasket 26 and the transparent sheet 30. As the bolts 40 are tightened, the sheet 30 and gasket 26, which are sandwiched between the frame members 32 and 36, compress together to thereby fluidly seal the transparent sheet to the boat hull 12. In doing so, openings 34 and 38 on the frame members 32 and 36, respectively, the hull opening 24 and the gasket opening 28 all register with each other while the gasket 26 protrudes outwardly from each side of the frame 36 and the sheet 30. A rectangular cover 43 is preferably positioned across the threaded ends of the bolts 40 to prevent accidental injury to the user.

Still referring to FIGS. 2 and 3, with the transparent sheet 30 secured to the boat hull 12 by the frames 36 and 32 in the above described fashion, the open lower end 22 of the housing 16 is positioned over the frame member 36 so that the bottom of the housing 16 abuts against the outwardly protruding portion 27 of the resilient gasket 26. The housing 16 is then secured to the boat hull 12 and compressed against the gasket 26 so that the housing 16 is fluidly sealed to the boat hull 12. Although any appropriate means can be used to secure the housing 16 to the boat hull, as shown a plurality of swivel bolts 44 are secured at their lower end to the boat hull 12 on opposite sides of the housing 16. Four mounting flanges 46 each having a central slot 48 are secured to the outer periphery of the housing 16 at its lower end so that each swivel bolt 44 is received within one slot 48 of one mounting flange 46. A wing nut 50 threadably engages each swivel bolt 44 so that upon tightening, the nuts 50 compress the bottom of the housing 16 against the outwardly protruding portion 27 of the gasket 26.

With reference now to FIG. 2, the upper end 20 of the housing 16 is contoured at 52 so that it flatly abuts against the face of a user and around his eyes. An opaque cushion 54 is preferably provided around the contoured upper end of the housing 16 which not only comforts the user's face but also prevents light leakage into the interior 18 of the housing 16.

In operation, the underwater viewing apparatus 10 according to the present invention is secured to the boat hull 12 in the previously described fashion and so that the upper end of the housing 16 is positioned above the water line for the boat 14. When underwater viewing is desired, the user positions his face across the open upper end 20 of the housing 16 and against the cushion 54, thus, blocking the entry of light through the open upper end 22 of the housing 16. The lower end of the housing 16 is sealed to the boat hull 12 which also prevents the entry of light into the interior 18 of the housing 16. The blockage of light from the interior 18 of the housing 16 creates a "shadow box" effect so that light only enters the interior 18 of the housing 16 through the transparent sheet 30 and results in clear and acute underwater viewing.

The gasket 26 further seals the transparent sheet 30 to the boat hull 12 thereby preventing the seepage of water into the bottom of the boat. However, in the event of breakage of the transparent sheet 30, water would rise only in the interior 18 of the housing 16 and only up to the water line for the boat 14. Possible flooding of the boat and the resultant safety hazard is thus totally eliminated.

The housing 16 can be moved from the boat hull 12 by simply removing the wing nuts 50 for storage, transportation and the like of the boat. In the event that the boat is to be operated without the housing 16, however, preferably a cover (not shown) is secured across the transparent sheet 30 to prevent flooding of the boat in the event of breakage of the transparent sheet 30.

From the foregoing it can be seen that the underwater viewing apparatus according to the present invention provides a simple, inexpensive and yet totally effective underwater viewing apparatus. Moreover, the viewing apparatus 10 is safe in operation even in the event of accidental breakage of the transparent sheet 30 and furthermore occupies only a very limited amount of space in the boat. Still further, the viewing apparatus of the present invention is preferably positioned adjacent the boat seat in the hull so as to permit simultaneous operation of the boat and viewing apparatus by a single person.

Having described my invention, however, many modifications thereto will become apparent to those skilled in the art to which it pertains without deviation from the spirit of the invention as defined by the scope of the appended claims.

We claim:

1. An underwater viewing apparatus for use with a boat having a hull and an opening formed through the hull, said viewing apparatus comprising:

a transparent plate disposed above said opening;

a flat gasket disposed between said plate and the boat hull around said opening, said gasket having a portion which extends outwardly from said opening and along said hull;

means for fastening said plate to said hull around said opening so that said gasket is sandwiched between said plate and said hull thereby fluidly sealing said plate to said hull, a housing having an open top, an open bottom and closed side walls, said bottom of the housing being positioned on said outwardly extending portion of said gasket, said housing being vertically dimensioned so that the top of the housing extends above the normal water line of said boat; and means for detachably securing said housing to said boat hull, said securing means further comprising means for variably compressibly clamping the open bottom of the housing to the hull so that the outwardly extending portion of the gasket is sandwiched between the housing and the hull to thereby form a fluid seal between said housing and said hull such that water will rise only within the interior of said housing in the event said plate ruptures.

2. The invention as defined in claim 1 wherein said housing is constructed of an opaque material, said housing having a contoured portion about its upper end, said contoured portion being adapted to contour against a face and around the eyes of a user.

3. The invention as defined in claim 2 and further comprising a cushion secured around the contoured portion of the upper end of the housing.

4. The invention as defined in claim 1 and further comprising a first frame member positioned above said plate, a second frame member positioned on the exterior bottom of the hull, each frame member having an opening in registry with said hull opening, and means for securing said frame members together whereby said plate, said gasket, and a portion of said hull are sandwiched between the frame members.

* * * * *